US011478032B2

(12) United States Patent
Brazelton

(10) Patent No.: US 11,478,032 B2
(45) Date of Patent: Oct. 25, 2022

(54) PULL-RELEASE CLOSURE APPARATUS AND METHOD

(71) Applicant: LoRonda Brazelton, Huntsville, AL (US)

(72) Inventor: LoRonda Brazelton, Huntsville, AL (US)

( * ) Notice: Subject to any disclaimer, the term of this patent is extended or adjusted under 35 U.S.C. 154(b) by 0 days.

(21) Appl. No.: 16/868,137

(22) Filed: May 6, 2020

(65) Prior Publication Data

US 2021/0345717 A1 Nov. 11, 2021

(51) Int. Cl.
*A41F 1/00* (2006.01)

(52) U.S. Cl.
CPC ..... *A41F 1/006* (2013.01)

(58) Field of Classification Search
CPC ..... A41F 1/006; A44B 11/2592
USPC ..... 450/86, 79
See application file for complete search history.

(56) References Cited

U.S. PATENT DOCUMENTS 3,200,464 A 8/1965 Cousins
4,917,651 A 4/1990 Rainville
6,260,242 B1 7/2001 Fildan
6,301,257 B1 * 10/2001 Johnson ..... H04Q 11/0478 370/392
6,386,944 B2 5/2002 Keith
6,431,947 B1 8/2002 Henz
7,942,723 B2 5/2011 Fildan
9,357,807 B2 * 6/2016 Berns ..... A41D 15/00
10,226,081 B2 * 3/2019 Berns ..... A41F 19/00
2002/0002761 A1 * 1/2002 Novak ..... A44B 11/2592 24/312
2007/0264905 A1 * 11/2007 Horta ..... A41C 3/124 450/41
2008/0066272 A1 * 3/2008 Hammerslag ..... A43C 11/14 24/712
2010/0139057 A1 * 6/2010 Soderberg ..... A63C 10/06 24/68 R
2011/0072566 A1 * 3/2011 Kovacevich ..... A41D 15/00 2/463

(Continued)

OTHER PUBLICATIONS

Glassmaster Cable Latch System, Glassmaster Controls, Kalamazoo, MI, USA, https://cdn.thomasnet.com/ccp/01052325/207179.pdf.

(Continued)

*Primary Examiner* — Gloria M Hale
(74) *Attorney, Agent, or Firm* — Lisa Foundation Patent Law Clinic at Arizona State University

(57) ABSTRACT

A pull-release closure apparatus and method. The apparatus comprises a separable fastener, comprising a male portion having a lug, a corresponding female portion having a hook detachably coupled to the lug, the hook further comprising a first substantially circular opening mounted on a peg, a second substantially circular opening, and a protrusion resting against a wall of the female portion. The apparatus comprises a cord coupled to the second substantially circular opening and extending outward from the separable fastener. The apparatus comprises a first garment attachment member comprising a first substantially rectangular opening, the first garment attachment member coupled to the male portion, and a second garment attachment member comprising a second substantially rectangular opening, the second garment attachment member coupled to the female portion.

14 Claims, 6 Drawing Sheets

(56) References Cited

U.S. PATENT DOCUMENTS

| | | | | |
|---|---|---|---|---|
| 2011/0266384 | A1* | 11/2011 | Goodman | A43C 11/165<br>242/396.4 |
| 2012/0004587 | A1* | 1/2012 | Nickel | A43C 11/165<br>602/21 |
| 2013/0203319 | A1* | 8/2013 | Torres | A41C 3/0028<br>450/59 |

OTHER PUBLICATIONS

Lever Release Shackle, McMaster-Carr, Elmhurst, IL, USA, https://www.mcmaster.com/rigging-latch-hooks.

* cited by examiner

PULL-RELEASE CLOSURE APPARATUS AND METHOD

BACKGROUND

1. Technical Field

Aspects of this document relate generally to systems and methods for a pull-release closure, which can be used as a garment closure of, for example, a brassiere.

2. Description of Related Art

Garment closures, especially brassiere closures, are rarely optimal for a user having a limited range of motion. For example, brassiere closures may emphasize discrete placement on the garment at the expense of accessibility. Moreover, a closure, discretely placed or otherwise, may be so inaccessible that users need to use both hands to fasten and unfasten the closure.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 3,200,464 discloses a separable fastener comprised of two cooperating members, each of which can be integrally secured to adjacent but separated areas or edges of wearing apparel, which may be quickly and simply coupled to form a positive securement of the adjacent parts or edges of the article to which such cooperating members are fastened as an integral part thereof.

U.S. Pat. No. 4,917,651 discloses a front opening brassiere for easy access and removal by a handicapped person, comprising: an adjustable top and bottom fabric fastening pads disposed in a space apart relationship on the underside of the overlapping portion to engage with corresponding support pad located on the top side of the brassiere cup with the overlapping portion. The fabric loop there assists in gripping overlapping portion of brassiere cup for access or removal.

U.S. Pat. No. 6,260,242 discloses a reversible press button closure (a "press button assembly") for back band connectors of brassieres, comprising soft attachment pieces secured to the garment and connected by pins and lugs with male and female ring members which are molded from a harder plastic.

U.S. Pat. No. 6,386,944 discloses a breast support system for a garment formed by shoulder supports, a midriff section, and a pair of breast cups interspaced between and connecting the shoulder supports and the midriff section. There, a draw strap is loosely guided by each track with one end affixed to a shoulder support and the second end exiting the cross track, passing through one guide, then through one midriff track, and ultimately secured by a grip.

U.S. Pat. No. 6,431,947 discloses a full-support brassiere that releases both the back band and shoulder straps via the release of a single fastener.

U.S. Pat. No. 7,942,723 discloses a length adjuster for connection between two parts of a garment with flexible tape having an outer end adapted for fixing to one of the garment parts and formed with a longitudinally extending row of grooves and an inner end.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present disclosure provides among other things a pull-release closure apparatus and method. The pull-release closure apparatus includes a separable fastener, a cord, and attachment members. The separable fastener includes a male portion, a female portion, and a hook.

In one embodiment a pull-release closure apparatus comprises a separable fastener comprising a male portion having a lug, a corresponding female portion having a hook detachably coupled to the lug, the hook further comprising a first substantially circular opening mounted on a peg, a second substantially circular opening, and a protrusion resting against a wall of the female portion, a cord coupled to the second substantially circular opening and extending outward from the separable fastener, a first garment attachment member comprising a first substantially rectangular opening, the first garment attachment member coupled to the male portion, and a second garment attachment member comprising a second substantially rectangular opening, the second garment attachment member coupled to the female portion.

In some embodiments the separable fastener may be coupled to a brassiere. In other embodiments the first garment attachment member may be coupled to a first wing of the brassiere. A second garment attachment member may be coupled to a second wing of the brassiere.

In other embodiments the cord may be coupled to a ring. In some embodiments the cord may comprise a knot. In other embodiments the cord may extend substantially horizontally from the separable fastener. In some embodiments the cord may extend substantially vertically from the separable fastener.

In some embodiments a pull-release closure method may comprise pulling a cord that extends from a separable fastener, the separable fastener comprising a male portion having a lug, a corresponding female portion having a hook detachably coupled to the lug, the hook further comprising a first substantially circular opening mounted on a peg, a second substantially circular opening coupled to the cord, and a protrusion resting against a wall of the female portion, and detaching the hook from the lug in response to the pulling of the cord.

In some embodiments a pull-release closure method may further comprise sliding the male portion into the female portion. In other embodiments a pull-release closure method may further comprise mounting the male portion onto the female portion. In some embodiments a pull-release closure method may further comprise snapping the male portion to the female portion.

In other embodiments a pull-release closure method may further comprise flexing of the protrusion against the wall of the female portion. In some embodiments the pull-release closure method may further comprise coupling of the hook to the lug.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that she can be her own lexicographer if desired. The inventor expressly elects, as her own lexicographer, to use only the plain and ordinary meaning of terms in the specification and claims unless she clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

In one application, a novel pull-release closure apparatus, specifically a pull-release apparatus as applied to garments, is provided.

Figure 1A:
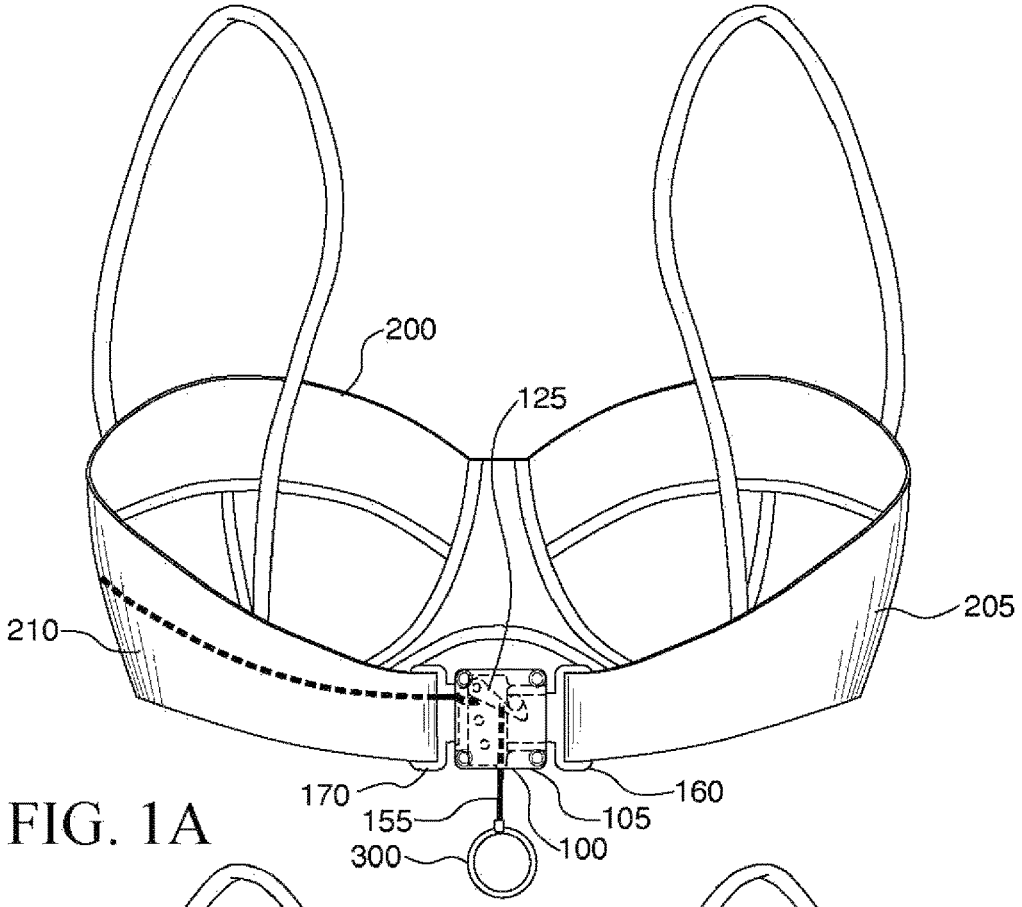
FIG. 1A depicts a frontal view of an implementation of a pull-release closure apparatus.

FIG. 1A illustrates a frontal view of an exemplary embodiment of a pull-release closure apparatus 100 as attached to a garment, more specifically, a brassiere 200. In one non-limiting embodiment, the pull-release closure apparatus 100 comprises a separable fastener 105 and a cord 155 extending outward from the separable fastener 105. The pull-release closure 100 further comprises a first garment attachment member 160 and a second garment attachment member 170. In some embodiments, the first garment attachment member 160 is coupled to a first wing 205 of the brassiere 200. In some embodiments, the second garment attachment member 170 is coupled to a second wing 210 of the brassiere 200. As shown, the first garment attachment member 160 and the second garment attachment member 170 couple the pull-release closure apparatus 100 to the brassiere 200. In some embodiments the first 160 and second 170 garment attachment members may be integrally formed into a garment. In some embodiments the first 160 and second 170 garment attachment members may be sewn or pinned to the garment. In some embodiments, the pull-release closure 100 may be coupled to a brassiere, a swimsuit, a bikini, a sports-brassiere, a belt, a pant, or a short.

In some embodiments the cord 155 is coupled to a ring 300. The cord 155 enables users to unfasten the separable fastener 105 with at least one hand. This may be advantageous for users with limited range of motion. The ring 300 may permit users to recognize the end of the cord 155 and may provide an area for the user to place a hand or finger when pulling. The ring 300 may also prevent complete uptake of the cord 155 into the brassiere's lining. In other embodiments, the cord 155 may extend substantially vertically from the separable fastener 105. This may enable a user to pull the cord 155 from the back of the brassiere 200, rather than the side.

Figure 1B:
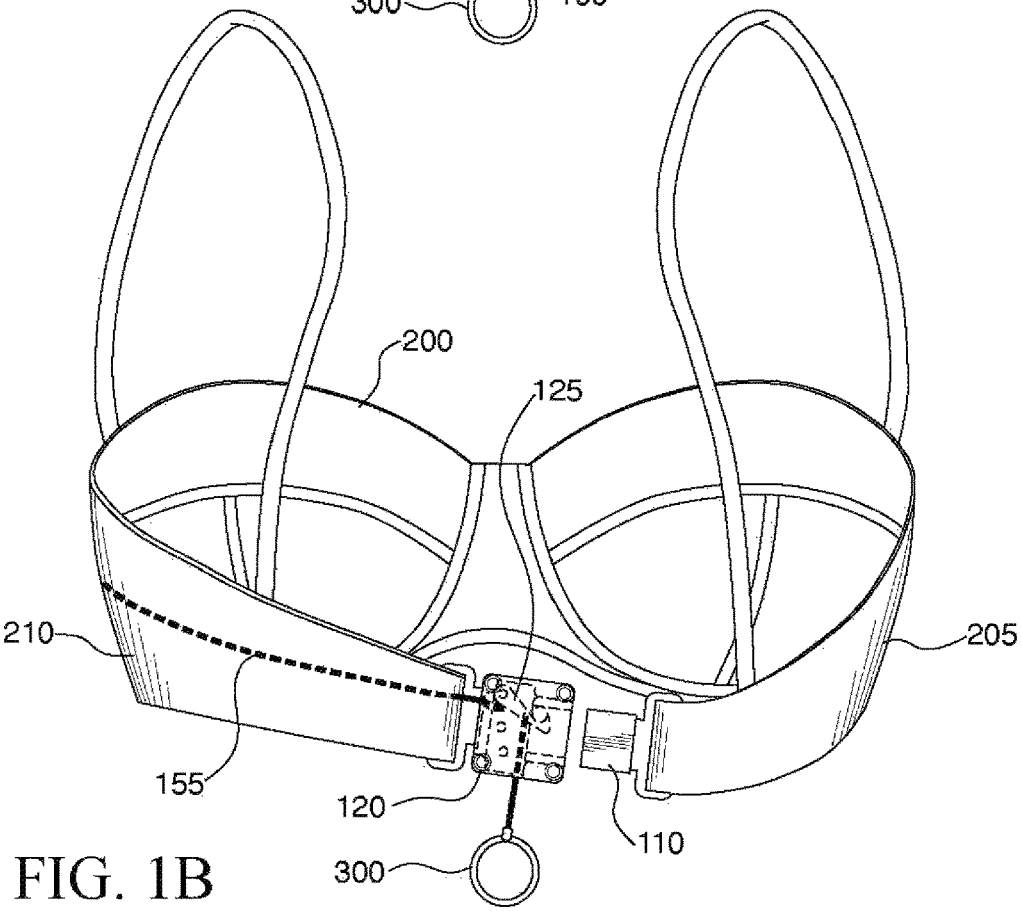
FIG. 1B depicts a frontal view of an implementation of a pull-release closure apparatus in an open configuration.

FIG. 1B illustrates a second frontal view of an implementation of the pull-release closure apparatus 100. In particular, this figure illustrates an exemplary embodiment of the pull-release closure apparatus 100 attached to the brassiere 200 in an open configuration. In some embodiments, the separable fastener 105 of the pull-release closure apparatus 100 comprises a male portion 110 and a female portion 120. This figure illustrates an exemplary embodiment of the male portion 110 coupled to the first garment attachment member 160, and the female portion 120 coupled to the second garment attachment member 170.

Figure 2A:
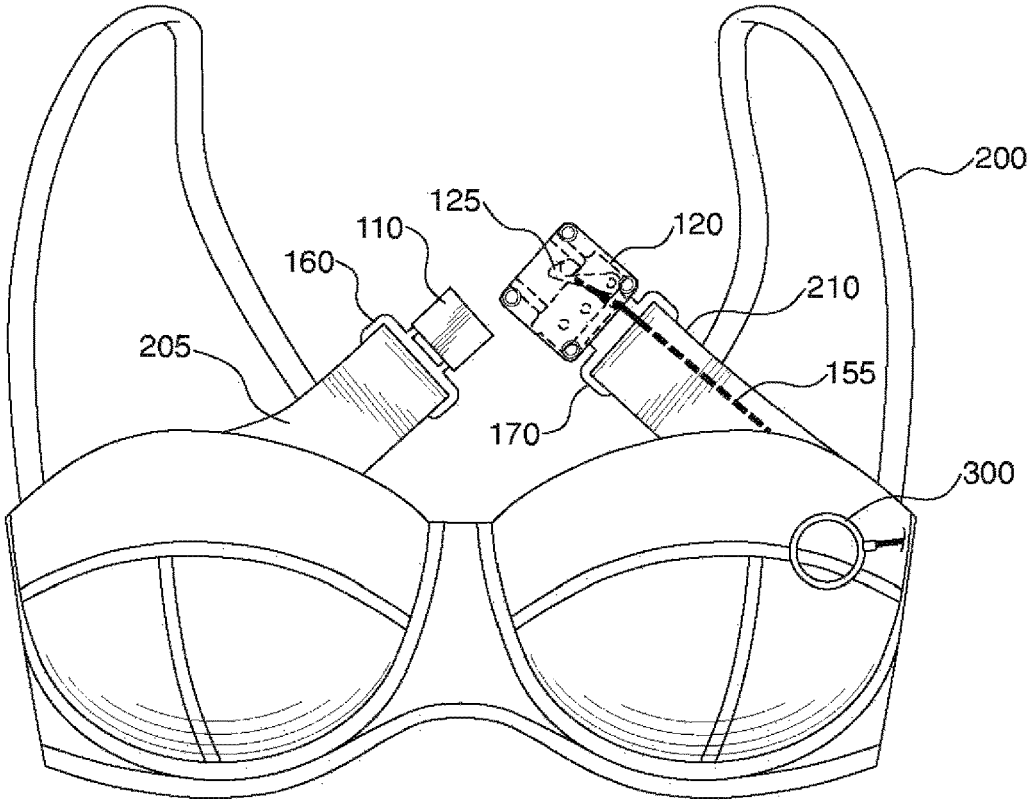
FIG. 2A depicts a rear view of an implementation of a pull-release closure apparatus and a ring.

FIG. 2A illustrates a rear view of an implementation of the pull-release closure apparatus 100, as attached to the brassiere 200 and in an open configuration. In particular, this figure illustrates an embodiment of the cord 155 extending substantially horizontally from the separable fastener 105. The cord 155 may be discreetly placed within the lining of the first wing 205 or second wing 210 of the brassiere 200 and may extend horizontally from the side of the brassiere 200. This enables a user to pull the cord 155 from the side of the brassiere 200, rather than the back.

Figure 2B:
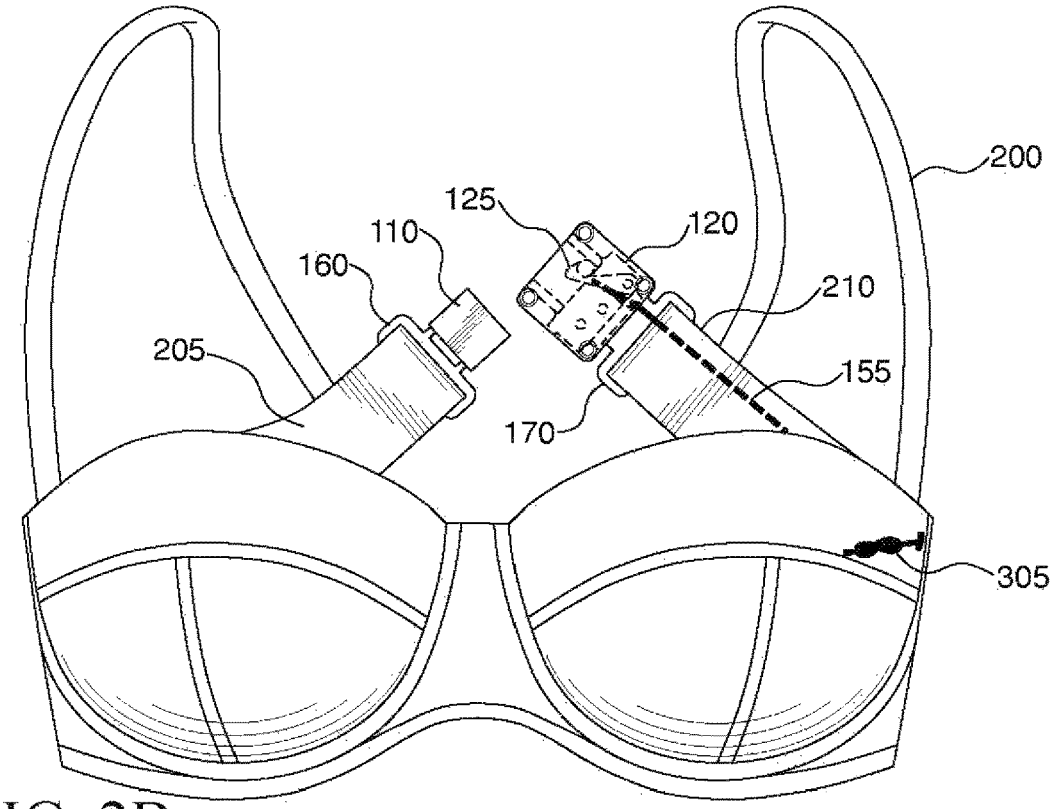
FIG. 2B depicts a rear view of an implementation of a pull-release closure apparatus and a knot.

FIG. 2B illustrates a second rear view of an implementation of the pull-release closure apparatus 100, as attached to the brassiere 200 and in an open configuration. In particular, this figure illustrates an implementation of the pull-release closure apparatus 100 wherein the cord 155 comprises a knot 305. The knot 305 may permit users to recognize the end of the cord 155 and may provide an area for the user to place a hand or finger when pulling. The knot 305 may also prevent complete uptake of the cord 155 into the brassiere's lining.

Figure 3A:
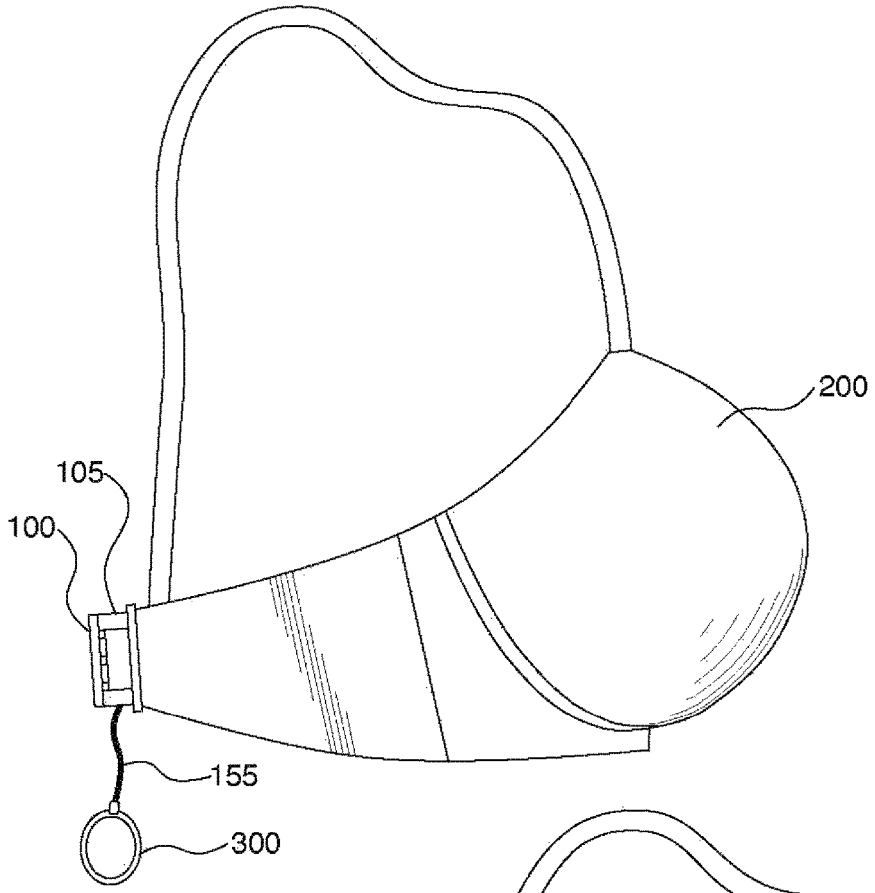
FIG. 3A depicts a side view of an implementation of a pull-release closure apparatus and a cord extending substantially vertically from a separable fastener.

FIG. 3A illustrates a side view of an implementation of the pull-release closure apparatus 100. In particular, this figure illustrates an implementation of the cord 155 extending substantially vertically from the separable fastener 105.

Figure 3B:
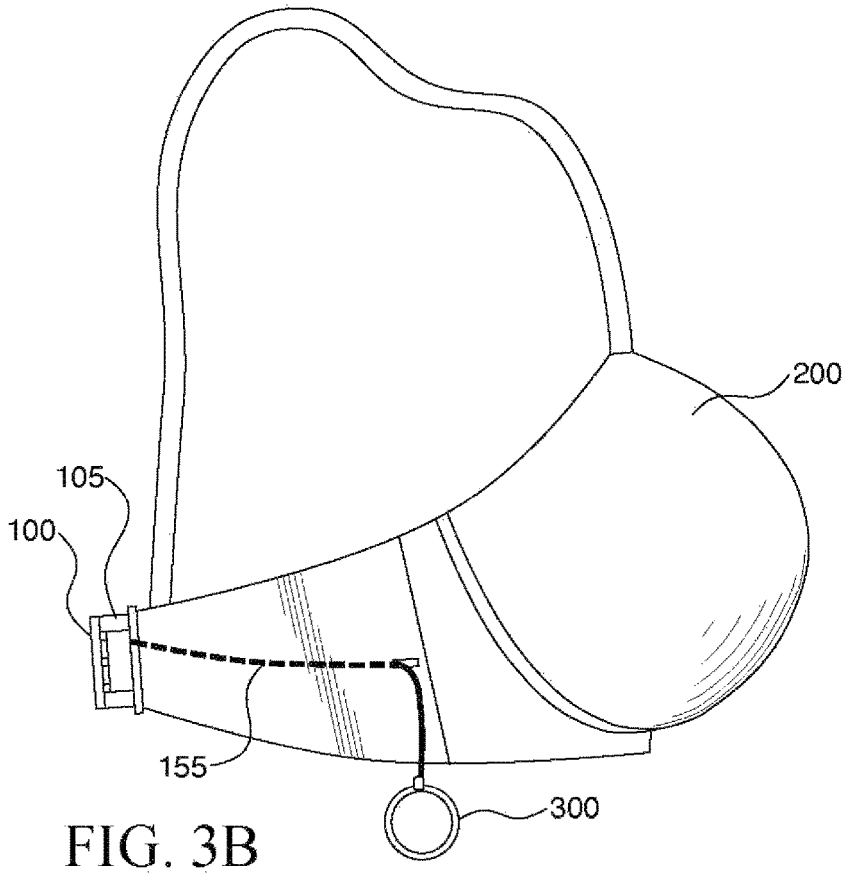
FIG. 3B depicts a side view of an implementation of a pull-release closure apparatus and a cord extending substantially horizontally from a separable fastener.

FIG. 3B illustrates a second side view of an implementation of the pull-release closure apparatus 100. In particular, this figure illustrates an implementation of the cord 155 extending substantially horizontally from the separable fastener 105.

Figure 4A:
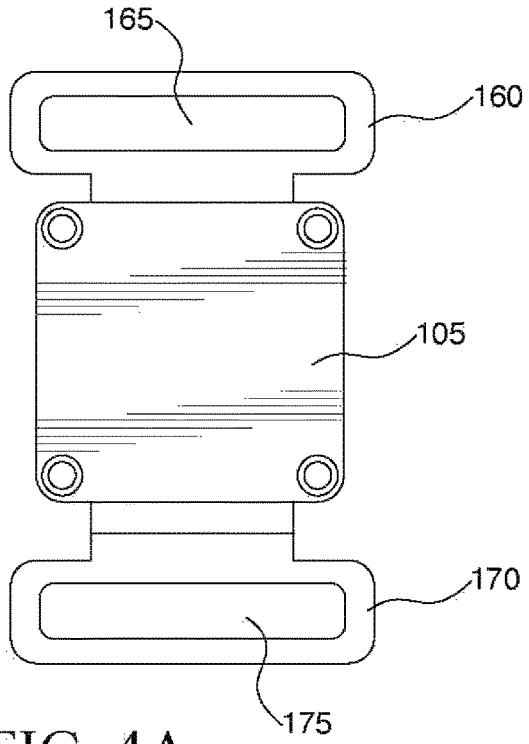
FIG. 4A depicts a frontal view of an implementation of a pull-release closure apparatus, more specifically a separable fastener, a first garment attachment member, and a second garment attachment member.

FIG. 4A illustrates a frontal view of an implementation of the pull-release closure apparatus 100. In particular, this figure illustrates an implementation of the separable fastener 105 coupled to the first garment attachment member 160, wherein the first garment attachment member 160 further comprises a first substantially rectangular opening 165, and the second garment attachment member 170, wherein the second garment attachment member 170 further comprises a second substantially rectangular opening 175. In some embodiments, the first 165 and second 175 substantially rectangular openings of the first 160 and second 170 garment attachment members may be shaped as any substantially regular or irregular polygonal figure, such as, by non-limiting example, a triangle, quadrilateral, pentagonal, hexagonal, or octagonal figure. In some embodiments, the first 165 and second 175 substantially rectangular openings of the first 160 and second 170 garment attachment members may be shaped as any circle, oval, oblong, or any other closed curve.

In some embodiments, the separable fastener 105 may be made of metal, plastic, or any other sufficiently rigid material that allows for proper operation of the separable fastener. In some implementations, the separable fastener 105 may be shaped as any regular or irregular polygonal figure such as, by nonlimiting example, a triangle, quadrilateral, pentagonal, hexagonal, or octagonal figure. In some embodiments, the separable fastener 105 may be shaped as any circle, oval, oblong, or any other closed curve.

Figure 4B:
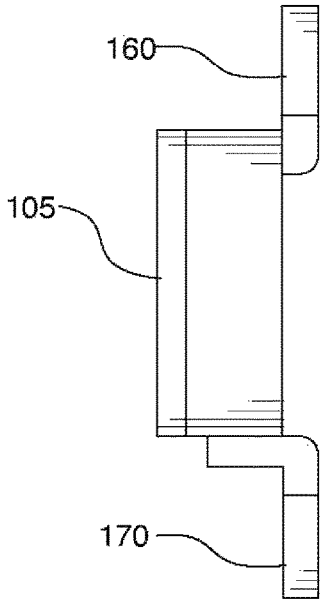
FIG. 4B depicts a topside view of an implementation of a pull-release closure apparatus, more specifically a separable fastener, a first garment attachment member, and a second garment attachment member.

FIG. 4B illustrates a topside view of an implementation of the pull-release closure apparatus 100. In particular, this figure illustrates an implementation of the separable fastener 105 coupled to the first garment attachment member 160 and the second garment attachment member 170.

Figure 4C:
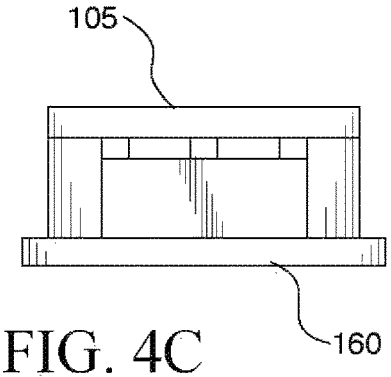
FIG. 4C depicts a side view of an implementation of a pull-release closure apparatus, more specifically a separable fastener and a first garment attachment member.

FIG. 4C illustrates a side view of an implementation of the pull-release closure apparatus 100. In particular, this figure illustrates an implementation of the separable fastener 105 coupled to the first garment attachment member 160.

Figure 4D:
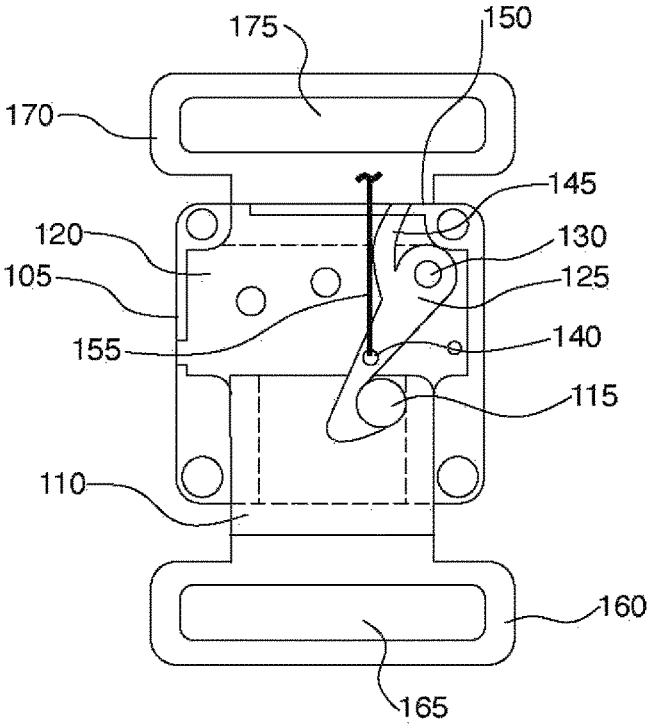
FIG. 4D depicts a cross-section view of an implementation of a pull-release closure apparatus, more specifically a cord, a separable fastener, a male portion, a lug, a female portion, a hook, and a protrusion.

FIG. 4D illustrates a cross-section view of an implementation of the pull-release closure apparatus 100. In particular, this figure illustrates an implementation of the first 160 and second 170 garment attachment members, and a cross-section view of an implementation of the separable fastener 105. In this non-limiting embodiment, the separable fastener 105 further comprises a male portion 110 having a lug 115, and a corresponding female portion 120 having a hook 125 detachably coupled to the lug 115. The hook 125 further comprises a first substantially circular opening 130 mounted on a peg 135, a second substantially circular opening 140, and a protrusion 145 resting against a wall 150 of the female portion 120. As seen in this implementation, the cord 155 extends outward from the separable fastener 105 and is coupled to the second substantially circular opening 140 of the hook 125. One or more gaps between the male portion 110 and the female portion 120 of the separable fastener 105 permit the cord 155 to pass therethrough.

In some implementations, the separable fastener 105 may comprise the female portion 120 having the lug 115, and the corresponding male portion 110 having the hook 125 detachably coupled to the lug 115. In such embodiments, the protrusion 145 may rest against the wall 150 of the male portion 110.

In some embodiments, the hook 125 and protrusion 145 may be made of nylon, rubber, fabric, or any other flexible material. In some embodiments, the hook 125 may be made of metal and the protrusion 145 made of nylon, rubber, tensile fabric, or any other flexible material.

The separable fastener 105 of the pull-release closure apparatus 100 may become detached when a user pulls the cord 155 extending from the separable fastener 105. In response to the pulling of the cord 155, the hook 125 is detached from the lug 115 and the male 110 and female 120 portions are separated from one another.

To recouple the male 110 and female 120 portions of the separable fastener 105, in some implementations, the user may slide the male portion 110 into the female portion 120. In other implementations, the user may mount the male portion 110 onto the female portion 120. In some other implementations, the user may snap the male portion 110 to the female portion 120.

To ensure the separable fastener remains in the closed position when the male 110 and female 120 portions are coupled, in some implementations, the protrusion 145 flexes against the wall 150 of the female portion 120 in response the force exerted by a user in sliding, mounting, snapping, or otherwise pushing the lug 115 of the male portion 110 against the hook 125 of the female portion 120. The hook 125 may then be coupled to the lug 115. In some other implementations, the protrusion 145 may flex against the wall 150 of the male portion 110 in response the force exerted by the user in sliding, mounting, snapping, or otherwise pushing the lug 115 of the female portion 120 against the hook 125 of the male portion 110. The hook 125 may then be coupled to the lug 115.

The flexing action of protrusion 145 enables the substantial positional integrity of the hook 125 with respect to the other elements in response to various movements by a user.

Figure 5A:
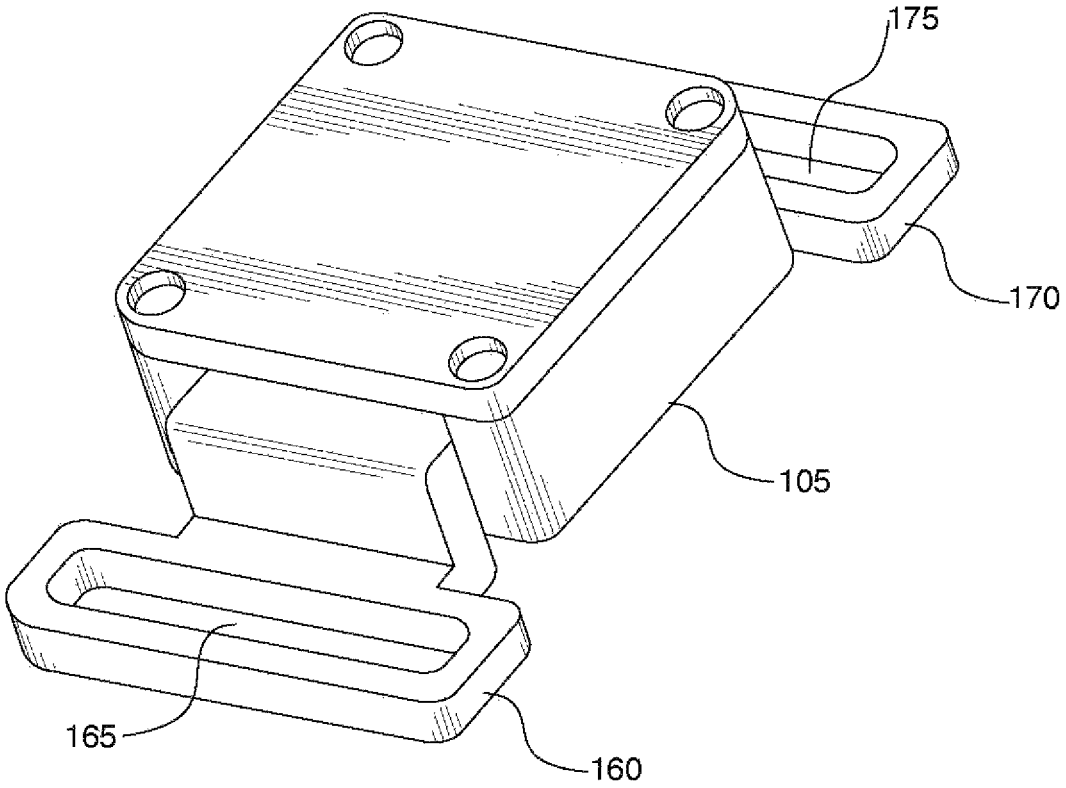
FIG. 5A depicts an oblique view of an implementation of a pull-release closure apparatus.

FIG. 5A illustrates an oblique view of an implementation of the pull-release closure apparatus 100. In particular, this figure illustrates an implementation of the separable fastener 105, and the first 160 and second 170 garment attachment members.

Figure 5B:
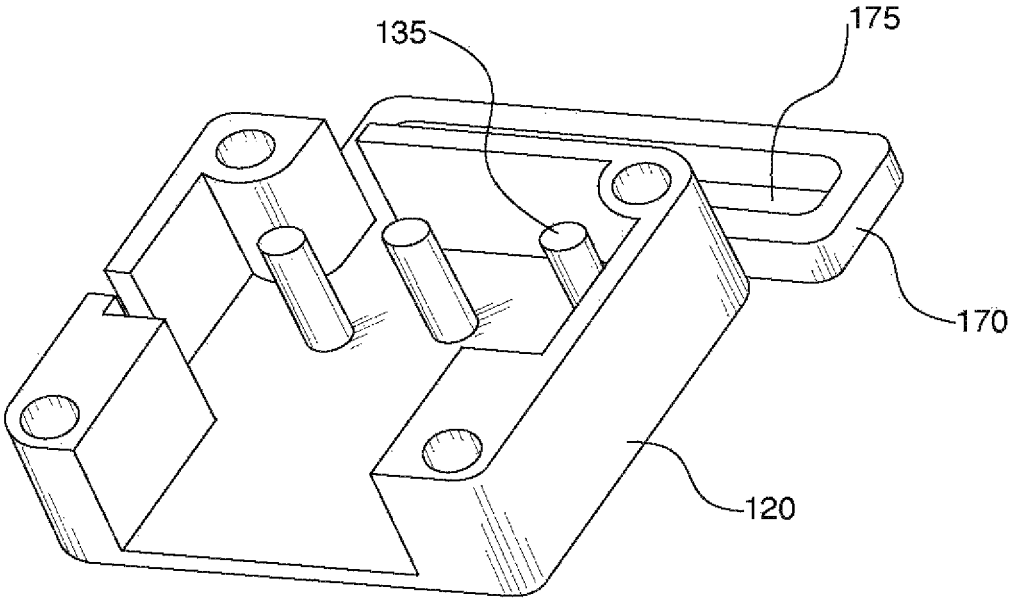
FIG. 5B depicts an oblique view of an implementation of a pull-release closure apparatus, specifically a female portion.

FIG. 5B illustrates an oblique view of an implementation of the pull-release closure apparatus 100. Specifically, this figure illustrates an implementation of the female portion 120 of the separable fastener 105 and the second garment attachment member 170.

Figure 5C:
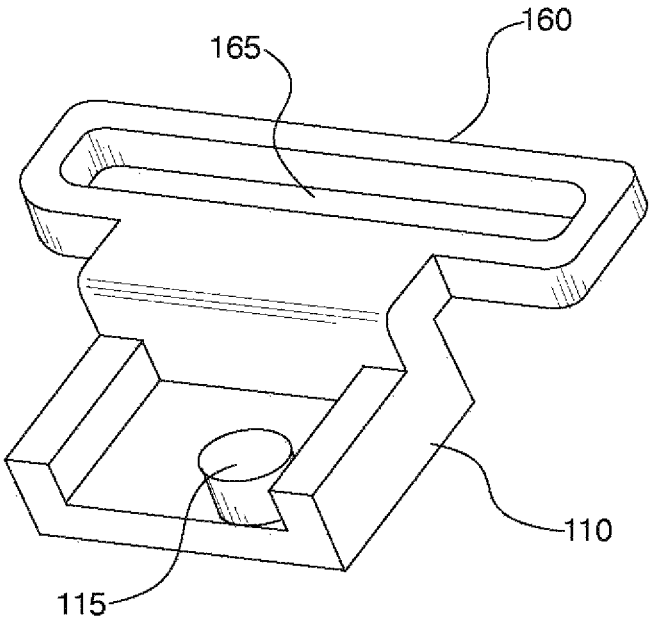
FIG. 5C depicts an oblique view of an implementation of a pull-release closure apparatus, specifically a male portion and a lug.

FIG. 5C illustrates an oblique view of an implementation of a pull-release closure apparatus 100. Specifically, this figure illustrates an implementation of the male portion 110 of the separable fastener 105 and the first garment attachment member 160.

I claim:

1. A pull-release closure apparatus, comprising:

a separable fastener configured to couple to a brassiere, the separable fastener comprising:
- a male portion having a lug;
- a corresponding female portion having a hook detachably coupled to the lug, the hook further comprising:
  - a first substantially circular opening mounted on a peg;
  - a second substantially circular opening; and
  - a protrusion resting against a wall of the female portion;

a cord coupled to the second substantially circular opening and extending outward from the separable fastener;

a first garment attachment member configured to couple to the lug, the first garment attachment member comprising a first substantially rectangular opening, the first garment attachment member coupled to the male portion; and a second garment attachment member configured to couple to the hook, the second garment attachment member comprising a second substantially rectangular opening, the second garment attachment member coupled to the female portion.

2. The pull-release closure apparatus of claim 1 wherein the separable fastener is coupled to the lug and the hook of the brassiere.

3. The pull-release closure apparatus of claim 1 wherein the first garment attachment member is coupled to a first wing of a brassiere.

4. The pull-release closure apparatus of claim 1 wherein the second garment attachment member is coupled to a second wing of a brassiere.

5. The pull-release closure apparatus of claim 1 wherein the cord is coupled to a ring.

6. The pull-release closure apparatus of claim 1 wherein the cord comprises a knot.

7. The pull-release closure apparatus of claim 1 wherein the cord extends substantially horizontally from the separable fastener.

8. The pull-release closure apparatus of claim 1 wherein the cord extends substantially vertically from the separable fastener.

9. A method of releasing a pull-release closure, the method comprising:

pulling a cord that extends from a separable fastener configured to couple to a brassiere, the separable fastener comprising:
- a male portion having a lug;
- a corresponding female portion having a hook detachably coupled to the lug, the hook further comprising:
  - a first substantially circular opening mounted on a peg;
  - a second substantially circular opening coupled to the cord; and
  - a protrusion resting against a wall of the female portion; and detaching the hook from the lug in response to the pulling of the cord.

10. The method of claim 9 further comprising sliding the male portion into the female portion.

11. The method of claim 9 further comprising mounting the male portion onto the female portion.

12. The method of claim 9 further comprising snapping the male portion to the female portion.

13. The method of claim 9 further comprising flexing of the protrusion against the wall of the female portion.

14. The method of claim 9 further comprising coupling of the hook to the lug.

* * * * *